US008444449B2

(12) United States Patent
Bowes

(10) Patent No.: US 8,444,449 B2
(45) Date of Patent: May 21, 2013

(54) AMUSEMENT APPARATUS AND METHOD FEATURING MAGNETIC BEADS

(76) Inventor: Duncan Bowes, Winnipeg (CA)

( * ) Notice: Subject to any disclaimer, the term of this patent is extended or adjusted under 35 U.S.C. 154(b) by 186 days.

(21) Appl. No.: 12/715,746

(22) Filed: Mar. 2, 2010

(65) Prior Publication Data

US 2010/0255751 A1 Oct. 7, 2010

Related U.S. Application Data

(60) Provisional application No. 61/166,982, filed on Apr. 6, 2009.

(51) Int. Cl.
*A63H 33/04* (2006.01)
*A63F 3/00* (2006.01)

(52) U.S. Cl.
USPC ..... 446/129; 273/126 A

(58) Field of Classification Search
USPC ..... 446/92, 97, 101, 137, 99, 118, 119, 446/129, 139; 273/348.3, 239, 271, 118 A, 273/450, 456
See application file for complete search history.

(56) References Cited

U.S. PATENT DOCUMENTS 250,458 A * 12/1881 Shay ..... 273/284
3,406,972 A * 10/1968 Wong ..... 273/118 A
3,652,086 A * 3/1972 Stecker ..... 273/292
5,031,907 A * 7/1991 Warehime ..... 273/443
5,072,936 A * 12/1991 Warehime ..... 273/450
5,209,486 A * 5/1993 Brotz ..... 273/239
5,250,000 A * 10/1993 Boutin et al. ..... 446/75
5,264,884 A * 11/1993 Michaud ..... 396/178
5,265,885 A * 11/1993 Blount ..... 273/348.3
5,328,188 A * 7/1994 Brotz ..... 273/239
5,370,397 A * 12/1994 Miller et al. ..... 273/283
5,421,581 A * 6/1995 Smith ..... 273/239
5,478,085 A * 12/1995 Canner et al. ..... 273/239
7,465,169 B2 * 12/2008 Roth et al. ..... 434/278
7,510,188 B2 * 3/2009 Yang et al. ..... 273/161
2008/0265508 A1 * 10/2008 Benedict ..... 273/272
2009/0072479 A1 * 3/2009 Spohn et al. ..... 273/236
2009/0189348 A1 * 7/2009 Kucharski ..... 273/288

* cited by examiner

*Primary Examiner* — Nini Legesse
(74) *Attorney, Agent, or Firm* — Kyle R. Saherthwait; Ryan W. Dupuis; Ade & Company Inc.

(57) ABSTRACT

An amusement apparatus comprises a plurality of magnetic beads sized for receipt in one or both hands of a user and a bead receiving surface onto which the magnetic beads are to be thrown. The thrown beads are allowed to cluster together so that a shape or indicator formed by the clustered beads can be visually recognized for drawing of meaning therefrom. The surface may include markings or indicia of which one is individually indicated after a throw by clustering of the beads proximate that marking. The markings may include letters for spelling of words by multiple throws of the beads or symbols associated with respective meanings that may be applied to the thrower of the beads.

9 Claims, 2 Drawing Sheets

1. bottom
1.a flat surface
1.b raised border 2. top
2.a flat surface
2.b raised border 3. magnetic material 4. multi theme flat surface insert

| | |
|---|---|
| 1. | bottom |
| 1.a | flat surface |
| 1.b | raised border |
| 2. | top |
| 2.a | flat surface |
| 2.b | raised border |
| 3. | magnetic material |
| 4. | multi theme flat surface insert |

AMUSEMENT APPARATUS AND METHOD FEATURING MAGNETIC BEADS

This application claims benefit under 35 U.S.C. 119(e) of U.S. Provisional Patent Application Ser. No. 61/166,982, filed Apr. 6, 2009.

FIELD OF THE INVENTION

This invention relates generally to amusement devices and methods of using same, and more particularly to an amusement device and method in which clustering of magnetic beads thrown onto a surface acts to produce a shape or indicator having a meaning associated therewith for application of the meaning against a user of the apparatus or a question posed before the throwing of the beads.

BACKGROUND OF THE INVENTION

A number of common amusement devices and practices rely upon chance or claims of mystical, occult, paranormal or psychic phenomenon to provided commentary on, or feedback in response to questions posed by, participants or spectators of the process being carried out. Devices of this type include Ouija™ boards that use a finger-tip touched pointer to provide yes/no or spelled-out answers to questions posed by the participants and Magic 8 Balls™ that use fluid motion when overturned to display one of several possible responses to a question posed by the turner of the ball or a spectator thereof. Fortune telling practices include palm reading, in which a practitioner comments on a participant's character traits or future on the basis of the lines of the person's palm, and tasseography, in which shapes or patterns are read from tea leaves, coffee grounds or wine sediments left behind after consumption of the respective drink by the participate.

Applicant has developed a game or apparatus and method of playing or using the same that similarly generates answers or predictions for one or more participants, but differs significantly from prior art devices and practices.

SUMMARY OF THE INVENTION

According to a first aspect of the invention there is provided an amusement apparatus comprising:

a plurality of magnetic beads sized for receipt in one or both hands of a user; and a bead receiving surface onto which the magnetic beads are to be thrown by the user for clustering of the beads together upon the playing surface and subsequent visual recognition of a shape or indicator formed by the clustering of the beads.

The bead receiving surface may have a raised border extending therearound to retain the magnet beads upon the playing surface during throwing.

The bead receiving surface may be defined by a closable box sized to receive the plurality of magnetic beads therein for storage.

The box preferably comprises a bottom panel defining the bead receiving surface and a plurality of walls projecting from the bottom panel to a common side thereof.

The box preferably comprises two separable sections each comprising a base panel and a plurality of wall panels projecting from the base panel to a common side thereof, the wall panels of one section being fittable externally over the wall panels of the other section to close the box and the base panel of each section defining a respective bead receiving surface.

The base panel of each section preferably has a distinct set of markings on the side thereof to which the wall panels project, the markings comprising different indicia spaced apart over the base panel of the section.

There may be provided a plurality of distinct inserts each sized to fit atop the bottom panel between the side panels, each insert having a distinct set of markings on at least one face thereof and the markings comprising different indicia spaced apart over the face of the insert.

Preferably each insert is double sided to have two distinct sets of markings on opposite faces of the insert.

The indicia may comprise individually placed letters for spelling of words by letters near which the beads cluster to form indicators of the letters during multiple throws of the beads onto the bead receiving surface.

The indicia may comprise individually placed symbols for reading of a symbol near which the beads cluster to form an indicator of the symbol upon throwing of the beads onto the bead receiving surface.

Preferably there are provided instructions outlining steps to be taken by the user in use of the amusement apparatus, the steps comprising throwing the plurality of magnetic beads onto the bead receiving surface and visually recognizing a shape or indicator formed by a cluster of beads thrown onto the bead receiving surface.

The instructions may provide meanings of a plurality of shapes in which the beads may cluster.

The instructions may provide meanings of a plurality of symbolic markings provided on the bead receiving surface to associate a symbolic marking near which the magnetic beads cluster when thrown with the user throwing the magnetic beads.

According to a second aspect of the invention there is provided an amusement method comprising the steps of:

(a) providing a plurality of magnet beads;

(b) providing a bead receiving surface onto which the plurality of magnetic beads can be thrown;

(c) throwing the plurality of magnetic beads onto the bead receiving surface;

(d) allowing the plurality of magnetic beads thrown onto the bead receiving surface to cluster together; and (e) visually recognizing a shape or indicator formed by the plurality of magnetic beads having clustered together in step (d).

The bead receiving surface may have indicia thereon at spaced locations thereover, step (e) comprising recognizing clustering of the plurality of magnetic beads proximate a respective one of the indicia after throwing onto the bead receiving surface as an indicator of said respective one of the indicia.

The indicia may comprise letters, steps (c) to (e) being repeated to spell out one or more words using respective letters indicated by the clustering of the beads during multiple executions of step (e).

The indicia comprise symbols having respective associated meanings and, the method further comprising an additional step of applying the respective associated meaning of the symbol indicated in step (e) by the clustering of the magnetic beads to a participant or spectator.

A plurality of bead receiving surfaces may be provided, each having a distinct set of markings thereon to define a respective indica layout and the method further comprising swapping one bead receiving surface for another between repeated executions of steps (c) to (e).

The plurality of bead receiving surfaces may comprise two bead receiving surfaces defined by respective top and bottom sections of a box, and the method further comprises storing the magnetic beads in the box when not in use.

The plurality of bead receiving surface may comprises at least one insert fittable inside a set of walls projecting from a bottom panel of a closable box assembly, the method further comprising placing the magnetic beads and each insert inside the closable box assembly for storage when not in use.

BRIEF DESCRIPTION OF THE DRAWINGS

In the accompanying drawings, which illustrate an exemplary embodiment of the present invention.

DETAILED DESCRIPTION

Figure 1:
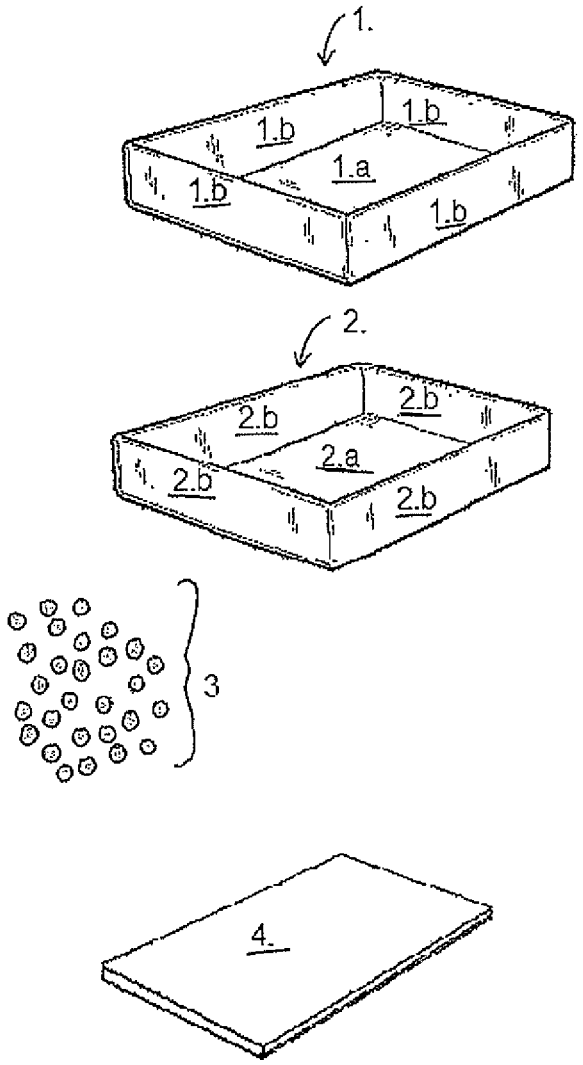
FIG. 1 is a schematic illustration of an amusement apparatus according to the present invention.
Figure 2:
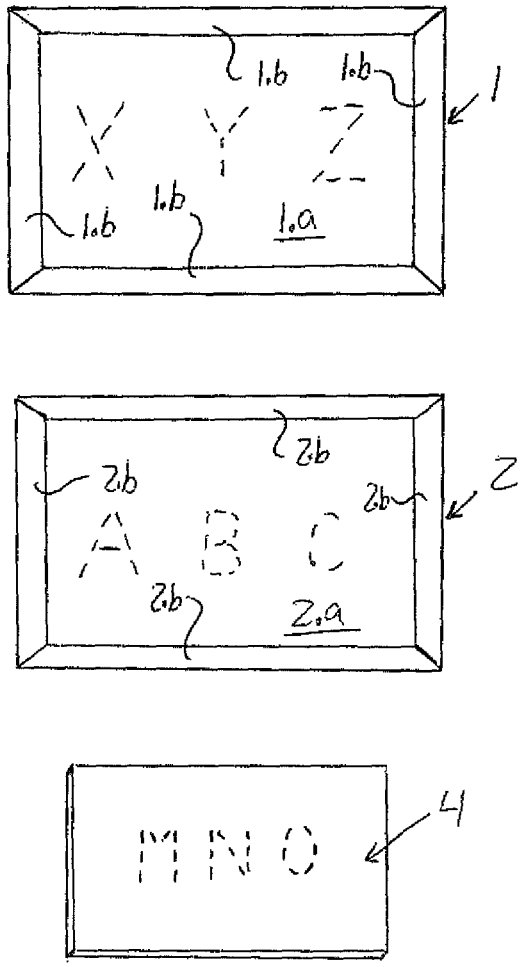
FIG. 2 is an overhead view of playing surfaces of top and bottom box sections and a box insert of the apparatus of FIG. 1, using broken lines to schematically illustrating different indicia on these playing surfaces.

The accompanying drawing shows an amusement apparatus according to the present invention. The apparatus comprises a two piece box assembly comprising a bottom section 1 and a mating top or lid section 2 that are selectively engagable together with one another to define a box in which the other components of the apparatus are to be stored when the apparatus is not in use.

The bottom section 1 comprises a planar rectangular base panel 1*a* having four planar rectangular wall panels 1*b* each extending along a respective perimeter edge of the base panel 1*a* to project perpendicularly upward from the base panel 1*a* at, and over the full length of, the respective perimeter edge. The wall panels 1*b* thus define a raised border or barrier closing around the flat upper surface of the base panel 1*a*.

Similarly, the lid section 2 comprises a planar rectangular base panel 2*a* having four planar rectangular wall panels 2*b* each extending along a respective perimeter edge of the base panel 2*a* to project perpendicularly upward from the base panel 2*a* at, and over the full length of, the respective perimeter edge. The wall panels 2*b* thus define a raised border or barrier closing around the flat upper surface of the base panel 2*a*. The lid section is dimensioned so that, with the bottom section 1 in the illustrated orientation having the bottom base panel 1*a* situated horizontally and the bottom wall panels 1*b* projecting vertically upward therefrom, the top section 2 can be oriented with the top base panel 2*a* situated horizontally over the bottom section 1 with centers of the two base panels 1*a*, 2*a* aligned with another so that the top wall panels 2*b* project vertically downward just outside the bottom walls panels 1*b*. The top section is lowered 2 downward onto the bottom section 1. In doing so, the side walls 2*b* of the top section 2 slide downward externally face-to-face over the side walls 1*b* of the bottom section 1 until the base panel 2*a* of the top section sits atop the side walls 2*b* of the bottom section.

The apparatus further includes a plurality of magnetic beads 3 sized for receipt of at least several, but preferably all, of the magnetic beads within cupped together hands of a user of the apparatus. The magnetic beads 3 which each exert a magnetic field that reaches well beyond its respective physical body and is strong enough to attract and attach to other beads in its immediate vicinity. The beads are preferably spherical, equally sized and between 75 and 150 in number. In use of the apparatus, several, and preferably all, of the beads 3 are gathered up in one or both hands of a user and then thrown, tossed or dropped so as to fall upon a horizontal surface. Due to the interaction of the magnetic fields of the beads, some or all of the beads will cluster together under magnetic attraction before all of the thrown beads stop moving and come to final resting positions atop the horizontal surface. A prototype of the apparatus featuring one hundred beads of 7 mm diameter has been found to work well, particularly when approximately half of the beads are collected in each hand and then dropped onto a horizontal playing surface from approximately one foot thereabove.

In one method of using the apparatus, a participant who did not throw the beads views the clustered together magnetic beads and visually recognizes a shape of the cluster as representation or approximation of a known object, symbol, animal, number, letter or other thing. The participant then goes on to associate the thing represented by the cluster of beads with the person who threw the beads by sharing or announcing the association. For example, if the cluster of magnetic beads resembles a heart in shape, then the participant may announce that the person who threw the beads is in love or will fall in love in the near future. The apparatus may include instructions on the throwing and shape recognition steps to completed during use of the apparatus for playing of a game using the same, in which case the instructions may include a listing of things that may be approximated in shape by the clustering beads and the meanings to be drawn therefrom for association with the bead thrower. Numerous guides are available concerning shape interpretation for tea leaf reading, and may be similarly applied to shape recognition and meaning for the apparatus of the present invention. One such example is *Tea-Cup Reading and Fortune-Telling by Tea Leaves, by a Highland Seer*, available as an e-book from Project Gutenberg (http://www.gutenberg.org) and herein incorporated by reference.

The above method of use may be carried out on any flat horizontal surface, or at least a surface sufficiently horizontal so as not to induce gravity driven movement of the beads to a predicable position along the surface under the slope thereof and sufficiently flat so as to not significantly interfere with magnetically driven movement of beads positioned in sufficient proximity to have their magnetic fields interact. The base panel of the bottom or top section of the illustrated two-piece box construction in which the magnetic beads are stored could provide such a surface for receipt of the beads thereon when thrown. Similarly, the base panel of a bottom section of a hinged, rather than separate, two-section box construction could be used as a suitable playing surface. In a hinged box in which the two sections are pivotal into parallel adjacent side-by-side positions with their base panels coplanar, a user could select from either of the base panels as a suitable playing surface. The use of a base panel, whether rectangular or otherwise, surrounded by wall panels on all sides as the playing surface blocks magnetic beads from moving off the playing surface when thrown thereonto.

For optional use in another method, the apparatus may include a bead-receiving playing surface having markings thereon to define indicia at spaced positions over the surface. In such an embodiment, instead of forming representative shapes to be associated with a participant when thrown upon the playing surface, the magnetic beads may instead be considered to form an indicator pointing to or indicating a particular one of the indicia on the surface based on which of the indicia the magnetic beads cluster closest to.

For example, the surface may have "yes" printed or otherwise displayed thereon at one location therealong and "no" printed or otherwise displayed at another location along the surface, spaced from the "yes" display. In this exemplary embodiment, the rules or instructions for use of the apparatus or playing of a game therewith would include asking a question to be addressed by the magnetic beads prior to throwing thereof upon the playing surface. The clustering of the beads near a respective one of the indicia indicates the answer spelled out by that particular one of the indicia. Answers beyond yes or no, such as those used in the Magic 8 Ball, may additionally be provided on the surface. Or instead of other answers, the surface may feature, in addition to or instead of "yes" and "no", all letters or characters of an alphabet, much like a Ouija board. In use of such an embodiment, multiple throws of the magnetic beads would be used to spell out one or more words using the letters indicated one-at-a-time by the clustering of the beads in a single throw. The words may be formed by sequentially indicated letters during sequential throws, or may be formed by rearranging or unscrambling of a series of letters so sequentially indicated, and instructions or rules may include one or both of these options.

In another example, instead of or in addition to any one or more of letters or answer words or phrases, the indicia markings or displays on the surface may be symbolic markings. For example, pictures or illustrations corresponding to different cards of a tarot card deck may be illustrated at different positions along the playing surface, so that clustering of the magnetic beads during any toss or throw thereof at or nearest a particular one of the tarot illustrations represents an indication of that particular tarot card meaning by the bead thrower. This is only one example of a symbol set that may be applied to the playing surface.

The apparatus may include more than one playing surface, each playing surface having a respectively distinct set of markings thereon to allow a user to select a desirable surface for a particular round of use of the apparatus. For example, one playing surface may have tarot illustrations, another may have answer words or phrases, another may have rune characters and another may have the English alphabet.

With reference to the illustrated embodiment, the base panel of each box section 1, 2 may define a respective playing surface on the face thereof facing the side of the base panel to which the respective side walls 1*b*, 2*b* commonly project. This way, laying of either box section on a table or other generally horizontal support structure with the box section walls projecting upward from the base panel forms a playing surface bound by the box section walls. Each planar base panel may be double-sided, having a distinct marking or indicia set on each of its two opposing faces. However, such a double sided version of the illustrated box section structure would only have raised border or enclosing boundary on one side of the base panel.

The apparatus may also or instead have one or more planar inserts 4 sized to fit within the interior of the box so as to sit flat atop the base panel of the bottom box section 1 and substantially cover the full area thereof, spanning fully between opposing end walls of the box section. With the separating two-piece box construction of the illustrated embodiment where the box section base panels 1*a*, 2*a* form playing surfaces, the insert 4 is sized to fit in either box section against the base panel thereof. Where one or each of the box's base panels defines an indicia marked playing surface, the insert has a distinctly different marking set to allow insertion into the marked box section against the base panel thereof with a marked side of the insert 4 facing away from the base panel to replace it as a different and distinct playing surface. The insert may be double sided with different and distinct marking sets on opposite faces thereof to allow selection of a particular one of its two playing surfaces based on which of the two is facing upward when the insert is used. Therefore, even with a single insert and with box sections printed on the inner faces thereof only, the apparatus features four different and distinct playing surfaces.

It will be appreciated that any playing surface whether having representative indicia thereon for indication by the beads or not can be used in the method relying on recognition of the clustered bead shape rather than indication of a particular indicia during a throw, toss or roll of the beads. Playing surfaces may be provided with different images printed or otherwise displayed thereon, even where the images are not intended or used to provide indicia to be indicated by the clustering magnetic beads during use of the playing surface. For example, an apparatus for purchase by a consumer may include multiple playing surfaces having different themes, or differently themed playing surface inserts may be separately sold for selection of particular themes by the consumer.

It will be appreciated that the associate of a meaning derived from a shape or indication of the cluster of magnetic beads need not necessarily be applied to the thrower of the beads, and may alternatively be associated with another participant involved. Likewise, the recognition of a shape of, or determination of an indication by, the clustered beads need not necessarily be performed a participant other than that who threw the beads. In addition, the association with or application of a meaning corresponding to the recognized shape or determined indication to one of the participants need not necessarily be performed by someone other than the participant to which the meaning is to be associated or applied. In other words, a participant may recognize the shape or determine the indication and apply or associate the corresponding meaning to him- or herself.

Instructions may be provided in printed form or in a computer readable form, such as in an electronic file stored on a computer readable medium such as a CD or DVD or published on the internet for retrieval using an internet address provided with a set of magnetic beads available for purchase.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An amusement method comprising the steps of:

(a) providing a plurality of magnet beads;

(b) providing a bead receiving surface onto which the plurality of magnetic beads can be thrown;

(c) allowing clustering of said beads together on the bead receiving surface solely through an action of rolling or tossing said plurality of magnetic beads onto said bead receiving surface, and visually recognizing a shape or indicator formed by the clustering of said plurality of magnetic beads; and (d) making a fortune telling statement concerning a participant based on the visually recognized shape or indicator.

2. The amusement method according to claim 1 wherein the bead receiving surface has indicia thereon at spaced locations thereover, and step (c) comprises recognizing clustering of the plurality of magnetic beads proximate a respective one of the indicia after throwing onto the bead receiving surface as an indicator of said respective one of the indicia, and step (d) comprises applying a meaning of said indicia in the fortune telling statement concerning the participant.

3. The amusement method according to claim 2 wherein the indicia comprise letters and step (c) is repeated to spell out one or more words using respective letters indicated by the clustering of the beads after multiple throws thereof, and step (d) comprises applying said one or more words in the fortune telling statement concerning the participant.

4. The amusement method according to claim 2 wherein the indicia each comprise a respective symbol.

5. The amusement method of claim 4 wherein step (d) comprises first comparing the respective symbol of the one of the indicia indicated by the plurality of magnetic beads against a guide that provides prescribed meanings for the symbols.

6. The amusement method according to claim 1 wherein a plurality of bead receiving surfaces are provided, each having a distinct set of markings thereon to define a respective indica layout, and the method further comprises swapping one bead receiving surface for another between repeated executions of step (c), in which clustering of the plurality of magnetic beads proximate a respective one of the indicia is recognized as an indicator of said respective one of the indicia, and whereby step (d) comprises applying a meaning of said indicia in the fortune telling statement concerning the participant.

7. The amusement method according to claim 6 wherein the plurality of bead receiving surfaces comprises two bead receiving surfaces defined by respective top and bottom sections of a box, and the method further comprises storing the magnetic beads in the box when not in use.

8. The amusement method according to claim 6 wherein the plurality of bead receiving surface comprises at least one insert fittable inside a set of walls projecting from a bottom panel of a closable box assembly, the method further comprising placing the magnetic beads and each insert inside the closable box assembly for storage when not in use.

9. The amusement method according to claim 1 wherein step (c) comprises visually recognizing the shape formed by the plurality of beads, and step (d) comprises first comparing the visually recognized shape against a guide that provides prescribed meanings for a plurality of shapes in which the beads may cluster.

* * * * *